United States Patent [19]

McKindary

[11] Patent Number: 4,723,431

[45] Date of Patent: Feb. 9, 1988

[54] METHOD FOR MANUFACTURING FORMED METAL

[75] Inventor: Thomas W. McKindary, Totowa Boro, N.J.

[73] Assignee: Serrated Rule Corp., Hawthorne, N.J.

[21] Appl. No.: 943,188

[22] Filed: Dec. 18, 1986

Related U.S. Application Data

[63] Continuation of Ser. No. 691,158, Jan. 14, 1985, abandoned.

[51] Int. Cl.[4] ..... B21D 5/08; B21D 7/08

[52] U.S. Cl. ..... 72/173; 72/170; 72/135

[58] Field of Search ..... 72/166, 168–175, 72/366, 160–162, 164, 165, 135

[56] References Cited

U.S. PATENT DOCUMENTS

| | | | |
|---|---|---|---|
| 522,487 | 7/1894 | Pleukharp | 72/171 |
| 542,572 | 7/1895 | Ritzwoller | 72/171 |
| 1,252,115 | 1/1918 | Hughes | 72/164 |
| 1,772,139 | 8/1930 | Hessenbruch | 72/173 |
| 2,390,274 | 12/1945 | Rose et al. | 72/170 |
| 2,401,720 | 6/1946 | Braun | 72/171 |
| 3,608,347 | 9/1971 | Kemminer | 72/170 |
| 3,645,155 | 2/1972 | Robinson | 83/663 |
| 4,008,595 | 2/1977 | Allenspach | 72/170 |
| 4,114,432 | 9/1978 | Miura et al. | 72/171 |
| 4,351,210 | 9/1982 | McKindary | 83/835 |

FOREIGN PATENT DOCUMENTS

| | | | |
|---|---|---|---|
| 293462 | 8/1916 | Fed. Rep. of Germany | 72/173 |
| 2606 | of 1898 | United Kingdom | 72/160 |
| 644830 | 10/1950 | United Kingdom | 72/171 |

*Primary Examiner*—Daniel C. Crane
*Attorney, Agent, or Firm*—Charles J. Brown

[57] ABSTRACT

The invention is a method and apparatus, and resultant product, for altering the form of material comprising the steps of synchronously driving a plurality of forming wheels, the forming wheels grooved to a radial depth of predetermined amount; spatially aligning the driven wheels in predetermined relationship; and feeding the material to be further formed successively to each of the forming wheels. The radial depth is sufficient to fully entrap the material. The shape of the groove conforms to the shape of the material with minimum clearance to prevent binding and yet to permit exertion of forming forces on the material.

4 Claims, 8 Drawing Figures

METHOD FOR MANUFACTURING FORMED METAL

This is a continuation, of application Ser. No. 691,158, filed Jan. 14, 1985, now abandoned.

FIELD OF THE INVENTION

This invention relates to a method and, for forming either a tempered or soft metal member into a curved or other form and particularly a method for forming such a curved form without prior notching, grooving, heating or other working of the raw material.

BACKGROUND OF THE INVENTION

In the rotary cutting rule field, particularly the manufacturing end, various approaches are employed to "work" the raw material in order to facilitate its formation.

For example, U.S. Pat. No. 3,645,155 describes a method for making a form member for a cutting machine comprising forming notches or openings in a rule spaced from the operative edge, and applying a ductile metal base.

Also, applicant's rule as described in U.S. Pat. No. 4,351,210, embodies a notched inner edge with a keyhole shape. A relevant article appeared in the December 1969 edition of Diemaking, Diecutting and Converting, entitled "Steel Rule for Rotary Die-Cutting of Corrugated Containers", authored by David K. Hart. The article identifies the need to notch the rule along its bottom edge for a distance something over half of its height in order to facilitate curving the rule.

Applicant's assignee and its predecessor in business have been in the rule manufacturing business for over fifty years. In their experience, curved rules, practically speaking, have been notched for the purpose stated above.

In notching and bending or curving rules, such as the one in U.S. Pat. No. 4,351,210, it has been the assignee ∝s observation that a slight bulging of the material, or tit, appears at the top of the keyhole or other notch. When the rule is inserted into the wooden dieboard, the contact surface area between the rule and die as a result are minimized. The retention capability of the die is thus reduced necessitating frequent resetting or replacement of the rule.

Also, the notching method results in the following relative disadvantages:

- extra time and work to fabricate the finished product;
- tendency of the resultant product to not bend accurately;
- the requirement for stress relief of the metal; other distortions and excess stress in the metal; hysteresis effects in the formed steel allowing it to tend to revert back toward its original form; weakening and fatiguing of the metal leading to possible breakage.

It is, therefore, a primary object of this invention to provide a new method for manufacturing curved metal or other materials in a way that obviates any one or all of the above disadvantages and in a less costly manner.

SUMMARY OF THE INVENTION

The invention is a method, for altering the form of material comprising the steps of synchronously driving a plurality of forming wheels, the forming wheels grooved to a radial depth of predetermined amount; spatially aligning the driven wheels in predetermined relationship; and feeding the material to be further formed successively to each of the forming wheels. The radial depth is sufficient to fully entrap the material. The shape of the groove conforms to the shape of the material with minimum clearance to prevent binding and yet to permit exertion of forming forces on the material.

BRIEF DESCRIPTION OF THE DRAWINGS

The following description of the preferred embodiment below will suggest various advantages of the new method, when taken with the drawings which are:

FIG. 2(*a–b*) enlarged views of a part of the design of the forming wheel of FIG. 2.

FIG. 3(*a*) an enlarged view of a part of the design of the forming wheel of FIG. 3.

DESCRIPTION OF THE PREFERRED EMBODIMENT

The following discussion will be developed in the context of the cutting rule industry. It is to be understood, however, that the described invention has possible broader application, for example, the formation of coil springs, or the formation of non-metallic materials, and this discussion is not to be thought of as limiting the invention's breadth.

Figure 1:
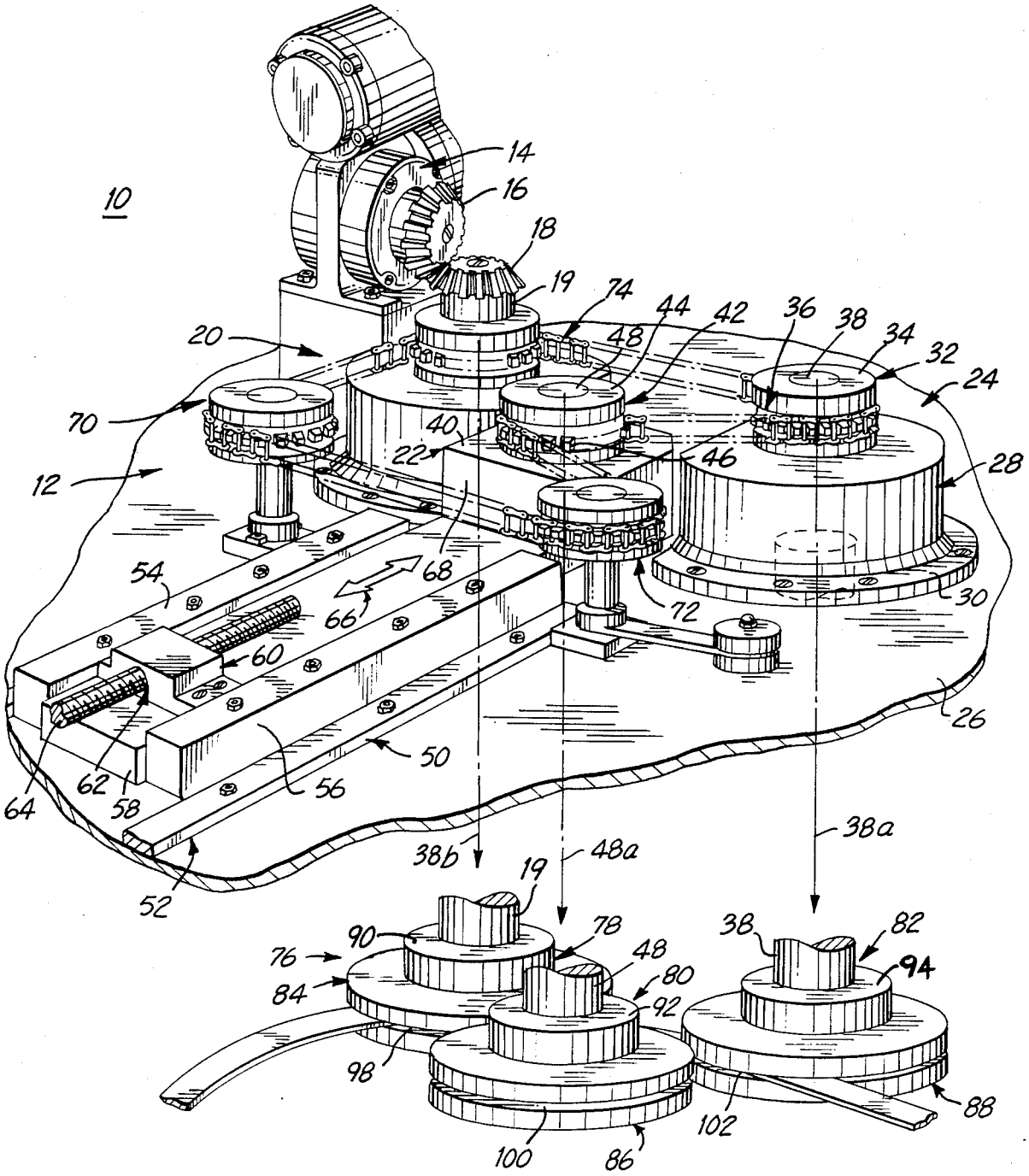
FIG. 1 a perspective view in section of the drive machinery and forming wheels utilized to accomplish the invention.

FIG. 1 depicts a forming apparatus 10 in accordance with the principles of the invention. The apparatus includes a drive assembly 12 which comprises a motor—gear drive arrangement 14 including a first miter gear 16 which engages a second miter gear 18 which is secured to the shaft member 19 of a first drive assembly 20.

For a typical application in the cutting rule industry, the motor horse power rating would be on the order of one-third h.p.

In addition to the first drive assembly 20, the forming apparatus includes second and third drive assemblies, 22 and 24. The first, second and third drive assemblies are positioend on a work plate 26. The drive assemblies, 20 and 24, are substantially identical and include an assembly mounting structure 28 which is secured through a flange member 30, by any one of many known methods, to work plate 26. The typical drive assembly further includes a hub assembly 32 comprising a pulley member 34 having a sprocketted, annular groove. The pulley member 34 is rotationally mounted in the mounting structure 28. Further, the pulley member is secured to shaft 38 which extends downward therefrom.

The second drive assembly 22 includes an assembly mounting structure 40 which is slideably disposed on the top surface of plate 26. It includes a hub assembly 42 which is rotationally positioned in a suitable opening in the mounting structure 40. The hub assembly 42 includes a sprocketted, annular groove 46. The hub assembly also includes a downwardly extending shaft 48 which is fixedly secured to the pulley 44 in a known way. Lines 38(*a*), 38(*b*) and 48(*a*) represent the longitudinal axes of the shaft members of the three hub assemblies.

Also positioned on plate 26 is an assembly, 50, for varying the relative position of the second drive assembly 22 in relation to drive assemblies 20 and 24. The assembly 50 includes a mounting plate member 52 which is secured to plate 26. Fixedly secured to the member 52 are guide blocks 54 and 56.

Positioned on the mounting plate member 52, between blocks 54 and 56, is a plate member 58. The latter is slideably disposed between the guide blocks 54 and 56.

Fixedly mounted to the plate member 58 is a yoke member 60 which includes a threaded opening 62. Extending through and in engagement with the threaded opening 62 is a screw shaft member 64. The screw shaft member 64 extends to the left as viewed in FIG. 1, and is rotatably mounted in a hub assembly (not shown) which is also secured to mounting plate member 52. Suitable handle means (also not shown) for rotating the screw member 64, clockwise or counterclockwise, are provided. Rotation of the handle means in either direction result in motion of the plate member 58 in either of the directions indicated by the arrows 66. By rotating the screw shaft the plate member 58 is urged into contact with surface 68 of mounting structure 40. In this way the relative position of the second drive assembly to the first and third drive assemblies can be adjusted.

Idler pulleys, 70 and 72, mounted in a known fashion to plate 26, provide means for taking up the slack in drive link chain 74. The chain interconnects the sprocketted grooves on each of the pulley members forming a part of the drive assemblies 20, 22, 24 and the idler pulleys resulting in synchronous, rotational movement of the pulleys and, in turn, the shafts connected thereto.

As noted above, the shafts extend downward from the drive assembly area, and as viewed in FIG. 1, to the forming wheel assembly 76 positioned below the plate member 26.

The forming wheel assembly 76 includes three wheel-hub assemblies 78, 80 and 82. Each of these includes a wheel member, 84, 86 and 88, respectively; shaft mounting hubs 90, 92 and 94; and shafts 38, 48 and 19 which are fixedly secured to the mounting hubs.

The spatial relationship of wheel assemblies 78 and 82 is fixed; while, the spatial relationship of the wheel assembly 80 to assemblies 78 and 82 can be altered in response to the movement of plate member 58.

Each wheel member forming a part of the wheel assemblies, includes an annular groove 98, 100 and 102. These annular grooves lie substantially in the same plane. The profile of each groove is better appreciated from FIGS. 2 and 3.

Figure 2:
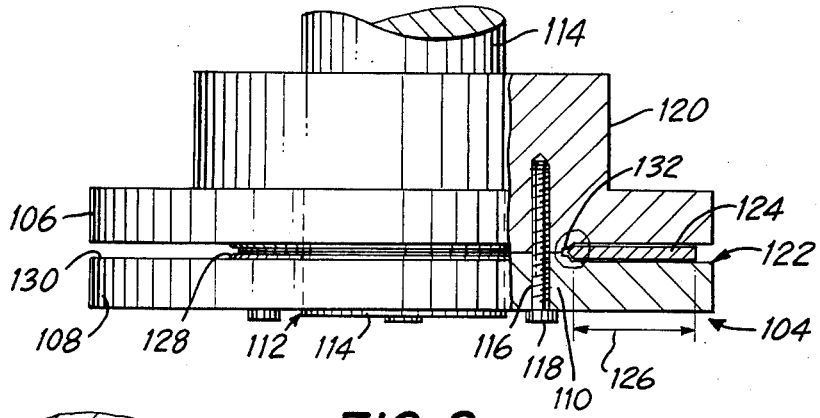
FIG. 2 elevation view partially in section of one embodiment of a forming wheel.
Figure 2B:
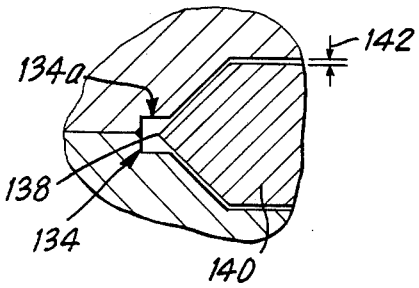
Figure 2A:
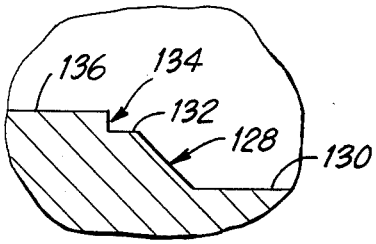

Referring to FIG. 2, a typical wheel member 104 is shown to include top and bottom half members 106 and 108. For the particular illustration in FIG. 2, members 106 and 108 are identical in form.

Typically, each half, for example 108, includes a central portion 110 having a thru opening 112 in which a shaft 114 is located and secured. The central portion further includes thru bolt holes, e.g. 116, which allow passage of bolts, e.g. 118. These bolts hold the top and bottom half members together to form one assembly and secure the assembly to the shaft mounting hub 120.

Each half member, again, such as 108, includes a first annular recess 122 typically machined into the metal surface at its perimeter. The recess 122 is cut to a depth sufficient to "capture" the material during the forming process. For example, in the cutting rule industry, the metal rule 124 is captured by the formed grooved in a way that bending forces are exerted on the rule while it is urged through the forming wheel members towards the end product collecting area. Generally, the radial depth of the annular recess is at least equal to the "height" of the metal as indicated by dimension 126.

Radially disposed inwardly of recess 122 is a second annular recess 128 which, for the application depicted, is chamfered. The chamfered surface extends from surface 130 of recess 122 to the surface 132 of yet a third annular recess 134. Surface 136 is the most inwardly disposed surface of central portion 110 and forms the contact surface with the corresponding area of the upper half member.

FIG. 2(*a*) enlarges the identified portion of FIG. 2 to provide a clearer understanding of the relationship of the various recesses and surfaces. FIG. 2(*b*) shows an enlarged view of the combined upper and lower halves in the vicinity of the chamfered and most inwardly disposed annular recesses. It is seen that recess 134 and recess 134(*a*) form, in effect, an annular groove which receives the edge portion, 138, of the cutting rule. This prevents the dulling or blunting of the cutting edge during the forming process.

As the rule 140 is urged radially inward into the groove formed by the upper and lower halves, as it advances through the forming wheels, the clearance, 142, in a typical application is on the order of 0.003 inches.

Figure 3:
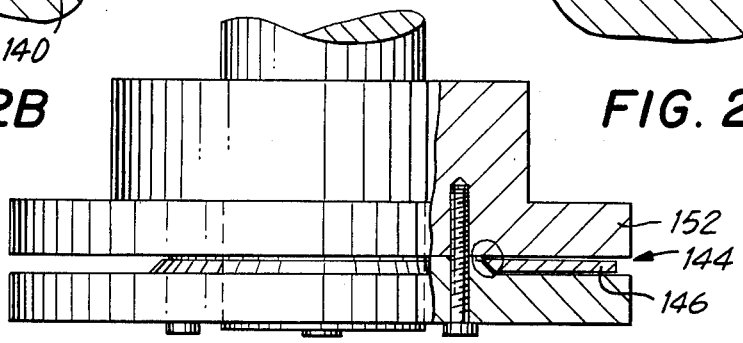
FIG. 3 elevation view partially in section of second embodiment of a forming wheel.
Figure 3A:
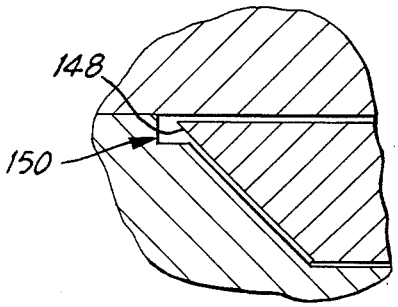

FIG. 3 and the enlarged view shown in FIG. 3(*a*), depict a wheel assembly including a formed annular groove 144 which is used to accommodate single-sided cutting rules such as 146. Again, the need for a relief groove to accommodate cutting edge 148 can be seen and which is provided by recess 150. Here, the upper member 152 is not machined at all but is essentially flat across the breadth of the member.

Generally, the shape of the annular groove in the forming wheel assembly will be such as to most closely reflect the profile of the particular material being formed. The spacing between the material to be formed and the groove again must be such as to insure exertion of sufficient force on the material to affect the forming purposes of the invention; and, still not negatively effect the formed material as, for example, dulling the cutting edge of a cutting rule product.

Figure 4:
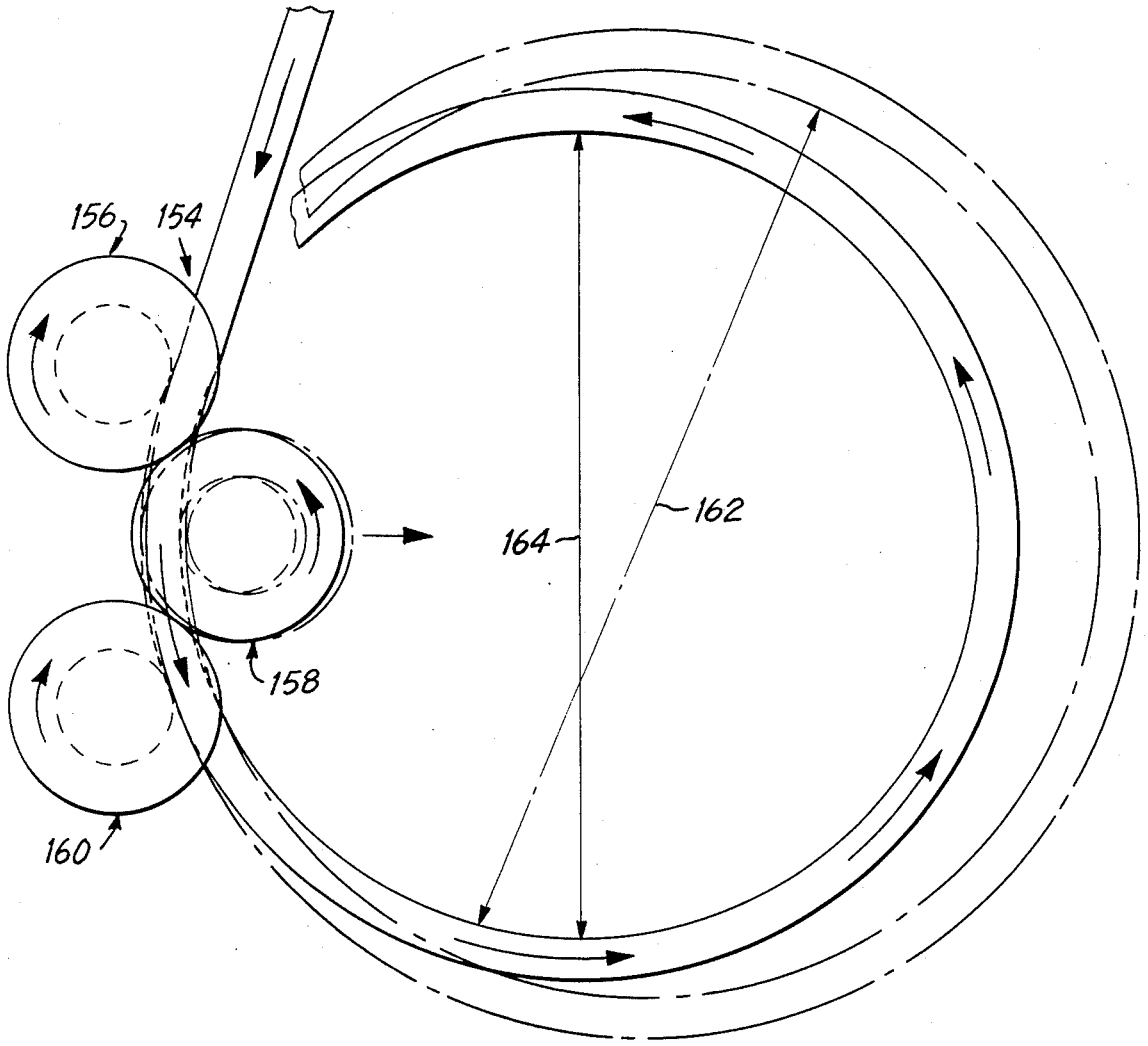
FIG. 4 plan view of the forming wheels and feeding of the unformed metal.

FIG. 4 is a schematic, plan view of the forming wheel assembly portion of the apparatus of the present invention. It illustrates the effect that the relative location between the center forming wheel and the two outside forming wheels has on the formed, end product. The stock material enters the forming wheel assembly at point 154 and is totally captured by the annular groove of the entry wheel member 156. The material being formed is then entrapped by the annular groove in the center wheel member 158; and then the annular groove in wheel member 160. Illustrated in FIG. 4 are two situations demonstrating the effect on the diameter of the formed product as it relates to the relative position of wheel member 158 and the other two. For the circumstance where the wheel member 158 is in closer proximity to members 156 and 160, the solid lines depict the relationship and the formed end product. For the circumstance where the wheel member 158 is more distant from members 156 and 160, this is depicted in phantom. It is apparent that the diameter 162 of the latter situation is larger than the diameter of the solid line configuration 164. In effect, the closer wheel member 158 is to the other two, the smaller the diameter of the formed product and conversely, the further away it is, the larger the diameter of the formed product.

In a typical application for the cutting rule industry, wheel members such as 156, 158 and 160 are on the order of 4 and 11/16 inch diameter. For a cutting rule height (dimension 126 in FIG. 2) of 1 inch, a rule thickness of 0.056 inch and a Rockwell temper of 35 on the "C" scale, a groove depth of 1⅛ inch has resulted in a 14 inch diameter of formed metal product for the closest spatial relationship between 158 and 156 and 160 found practical; and a diameter of close to 26 inches when wheel member 158 is most distant from the two stationary members. If it were desired to fabricate a formed metal product having a smaller inside diameter than 14 inches, the diameter of the wheel members would have to be reduced from those indicated.

Although the speed at which the stock material enters the forming wheel assembly area appears not to be a major consideration, applicant has fabricated finished cutting rules with forming speeds on the order of 9 feet per minute.

The various sprocketted pulleys and other machine parts forming the components of the drive assembly are, typically, made from cold roll steel. The forming wheels which contact the stock metal material are made from material which will reduce the wear created by the frictional forces encountered. For example, applicant has employed oil hardened M2 steel to fabricate its forming wheels.

Figure 5:
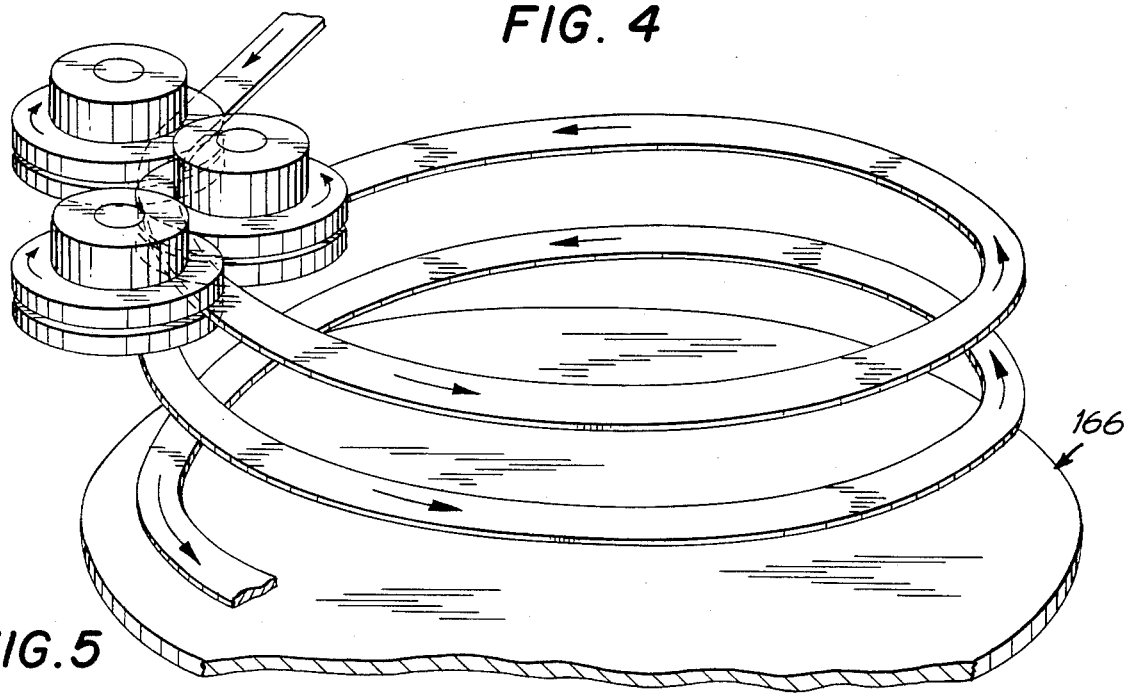
FIG. 5 perspective view of the forming wheels and formed product.

FIG. 5 shows in perspective how the accumulated material is collected. A simple procedure is to allow gravity to bring the formed material down onto a table surface 166 which is free to rotate and responds to circular movement of the formed material as it leasves the forming wheel assembly.

The described invention achieves many advantages. These include:

1. Significantly reducing stress and distortion in the curved end product.
2. Eliminating need to stress relieve the material.
3. Better retention of the finished form.
4. A more precise bend in the formed product.
5. Improvement in product strength.
6. More accurate curves.
7. Facilitating subsequent use of the formed product such as permitting easy insertion into die boards for cutting rules while improving the retention power of the formed product in the die board.
8. Eliminating additional steps such as notching, grooving or possible heating.

Again, although the description centers on applicant's primary field, it is anticipated that with appropriate adjustment of the invention of various parts particularly the forming wheel size and groove depth and size, the principles of the invention can be applied to other material forming areas including non-metal.

Also, it is anticipated that the principles of the invention have application in an apparatus designed to "work in reverse", i.e. to straighten curved or otherwise imperfect material.

Certainly other variations of the above will now come to mind to others in view of the disclosure herein. Of course, the breadth of the invention is not limited to the particular description above, but, rather, is defined by the claims which follow.

What is claimed is:

1. In a method of working indefinite lengths of stock strip of rectangular cross section having opposed side faces and narrower opposed edge portions wherein the strip is bent in the general plane of the faces as it passes edgewise between opposed parallel side walls of similar co-planar annular grooves in at least three successive offset wheels, all of the three grooves being of substantially identical cross section, so that the opposite strip edge portions are subjected to compression and tension on the inside and outside respectively of given bends, the opposed side walls of each engagement against the strip side faces, the improvement which comprises (a) maintaining minimal clearance between the side walls of each groove and the strip side faces so that the groove side walls slide against the strip side faces and working forces are thereby exerted directly on the strip side faces by the groove side walls to prevent thickening of the strip edge portions under compression on the inside of a given bend; and (b) providing a groove depth greater than the strip side face width so that the full strip side faces are encaptured within and worked by the groove side walls as the stock strip passes from one groove to the next.

2. A method according to claim 1 wherein the stock strip is initially nominally straight and as a consequence of the working is formed into curved configuration.

3. A method according in claim 1 wherein the stock strip is initially curved and as a consequence of the working is formed into substantially straight configuration.

4. A method according to claim 1 wherein the stock strip is of metal and the opposed side faces of the strip and the opposite side walls of the grooves are each flat and parallel.

* * * * *

UNITED STATES PATENT AND TRADEMARK OFFICE

CERTIFICATE OF CORRECTION

PATENT NO. : 4,723,431

DATED : February 9, 1988

INVENTOR(S) : Thomas W. McKindary

It is certified that error appears in the above-identified patent and that said Letters Patent is hereby corrected as shown below:

Column 6, line 29, after "each" insert -- groove turning in sliding working --.

Signed and Sealed this

Sixteenth Day of August, 1988

*Attest:*

DONALD J. QUIGG

*Attesting Officer*

*Commissioner of Patents and Trademarks*